US009927737B2

(12) United States Patent
Yoshida et al.

(10) Patent No.: US 9,927,737 B2
(45) Date of Patent: Mar. 27, 2018

(54) DEVELOPING APPARATUS AND PROCESS CARTRIDGE

(71) Applicant: CANON KABUSHIKI KAISHA, Tokyo (JP)

(72) Inventors: Nobuyoshi Yoshida, Suntou-gun (JP); Shuhei Kawasaki, Susono (JP); Hideki Kakuta, Suntou-gun (JP); Akihiro Fujiwara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/472,143

(22) Filed: Mar. 28, 2017

(65) Prior Publication Data

US 2017/0285520 A1 Oct. 5, 2017

(30) Foreign Application Priority Data

Mar. 30, 2016 (JP) ..... 2016-069288
Feb. 24, 2017 (JP) ..... 2017-033910

(51) Int. Cl.
*G03G 15/08* (2006.01)
*G03G 21/18* (2006.01)

(52) U.S. Cl.
CPC ..... *G03G 15/0865* (2013.01); *G03G 15/0875* (2013.01); *G03G 15/0887* (2013.01); *G03G 15/0889* (2013.01); *G03G 15/0896* (2013.01); *G03G 21/18* (2013.01); *G03G 21/1803* (2013.01); *G03G 21/1814* (2013.01)

(58) Field of Classification Search
CPC ..... G03G 15/0865; G03G 15/0887; G03G 15/0875; G03G 15/0889; G03G 15/0896
See application file for complete search history.

(56) References Cited

U.S. PATENT DOCUMENTS

2008/0247784 A1* 10/2008 Kakuta ..... G03G 15/0875 399/263
2009/0297175 A1* 12/2009 Kakuta ..... G03G 15/0856 399/27
2011/0123205 A1* 5/2011 Satomura ..... G03G 15/0856 399/27
2012/0148314 A1* 6/2012 Park ..... G03G 21/1814 399/281

(Continued)

FOREIGN PATENT DOCUMENTS

JP 2008-209897 A 9/2008
JP 2011-39554 A 2/2011

(Continued)

*Primary Examiner* — Ryan Walsh
(74) *Attorney, Agent, or Firm* — Canon U.S.A., Inc. IP Division

(57) ABSTRACT

There is provided a developing apparatus including a conveyance member configured to bend in contact with an inner wall of a conveyance chamber and convey developer, a portion configured to bend the conveyance member, and a first releasing portion configured to release the bending of the conveyance member, a deforming portion configured to bend the conveyance member moved and released from the first releasing portion, and a second releasing portion configured to release the bending of the conveyance member on the downstream side of the deforming portion in the rotational direction of the conveyance member.

10 Claims, 7 Drawing Sheets

(56) References Cited

U.S. PATENT DOCUMENTS

| | | | | |
|---|---|---|---|---|
| 2013/0272727 | A1* | 10/2013 | Hirukawa | G03G 15/556 399/27 |
| 2014/0079416 | A1* | 3/2014 | Hirukawa | G03G 15/0862 399/27 |
| 2016/0252848 | A1* | 9/2016 | Abe | G03G 15/0891 399/254 |
| 2016/0252874 | A1* | 9/2016 | Fujiwara | G03G 21/1652 399/27 |

FOREIGN PATENT DOCUMENTS

| | | | |
|---|---|---|---|
| JP | 2011-253203 | A | 12/2011 |
| JP | 2015-200867 | A | 11/2015 |

* cited by examiner

DEVELOPING APPARATUS AND PROCESS CARTRIDGE

BACKGROUND

Field of the Disclosure

The present disclosure relates to an electrophotographic image forming apparatus to and from which a toner conveying apparatus, a cleaning unit, and a process cartridge are attachable and detachable.

Description of the Related Art

In an image forming apparatus employing the electrophotographic image forming process (electrophotographic process), such as a printer, an electrophotographic photosensitive member (hereinafter simply referred to as a photosensitive member) as an image bearing member is uniformly electrically charged. Subsequently, the electrically charged photosensitive member is selectively exposed to light to form an electrostatic image on the photosensitive member. Subsequently, the electrostatic image formed on the photosensitive member is visualized as a toner image by using toner as developer. Then, the toner image formed on the photosensitive member is transferred onto a recording material such as recording paper and a plastic sheet, and the toner image transferred onto the recording material is heated and pressurized to be fixed onto the recording material, thus completing image recording.

Such an image forming apparatus generally requires the maintenance of various types of process units. To facilitate the maintenance, the above-described photosensitive drum, charging unit, developing unit, and cleaning unit are integrated in a frame member as a cartridge. This cartridge is practically used as a process cartridge that is attachable to and detachable from an image forming apparatus (apparatus main body). The process cartridge method enables providing an image forming apparatus having excellent usability.

With a certain image forming apparatus of in-line type including a plurality of photosensitive members juxtaposed in a direction perpendicularly intersecting with the vertical direction, a plurality of photosensitive members is disposed under an intermediate transfer member as a transfer-receiving member or under a recording material bearing member for conveying a recording material as a transfer-receiving member.

When disposing photosensitive members under an intermediate transfer member or a recording material bearing member, for example, a fixing apparatus and a developing apparatus (or an exposure apparatus) can be disposed at separate positions so as to sandwich the intermediate transfer member or the recording material bearing member in the image forming apparatus main body. This configuration has an advantage that the developing apparatus (or exposure apparatus) is unlikely to be affected by the heat of the fixing apparatus.

When disposing photosensitive members under an intermediate transfer member or a recording material bearing member in this way, a developing apparatus needs to convey a developer against gravity (refer to Japanese Patent Application Laid-Open No. 2011-39554).

A developing apparatus generally includes a developing chamber including a developer bearing member for supplying a developer to a photosensitive member and a developer supply member for supplying the developer to the developer bearing member, and a conveyance chamber (developer containing chamber) including a conveyance member for supplying the developer to the developing chamber. The developing apparatus needs to supply the developer from the conveyance chamber positioned below the developing chamber to the developing chamber against gravity.

Japanese Patent Application Laid-Open No. 2011-39554 discusses a method for rotatably disposing a conveyance member having a flexible sheet member as a unit for conveying a developer from a conveyance chamber to a developing chamber disposed above the conveyance chamber.

In such a configuration, even if a large amount of the developer is supplied from the conveyance chamber at one time, part of the developer exceeding the capacity of the developing chamber is not supplied to a developer bearing member but returned from the developing chamber to the conveyance chamber. Therefore, in a case where the frequency of developer supply by the conveyance member is low, the developer in the developing chamber may become insufficient. In this case, therefore, the conveyance member needs to supply the developer to the developing chamber at a suitable frequency. However, increasing the number of rotations (rotation speed) of the conveyance member intending to increase the frequency of developer supply increases torque required to rotate the conveyance member, possibly resulting in an increase in power consumption. In some cases, impact noise occurring when the conveyance member hits an opening between the developing chamber and the conveyance chamber may increase.

SUMMARY

The present disclosure is directed to a developing apparatus configured to convey a developer against gravity and capable of increasing the frequency of developer supply from a conveyance chamber to a developing chamber without increasing the rotation speed of a conveyance member.

According to an aspect of the present disclosure, a developing apparatus includes a developing frame member including a conveyance chamber, and a developing chamber disposed above the conveyance chamber in a gravitational direction at a time of image formation, a partition configured to divide an inside of the developing frame member into the developing chamber and the conveyance chamber, and provided with an opening for communicating between the developing chamber and the conveyance chamber, a developer bearing member stored in the developing chamber, a conveyance member stored in the conveyance chamber, and configured to rotate to convey developer into the developing chamber through the opening, and an inner wall surface disposed inside the conveyance chamber, wherein the inner wall surface includes an inclined surface positioned below a rotation center of the conveyance member in the gravitational direction, and inclined toward an upside in the gravitational direction and toward a direction departing from the rotation center in a horizontal direction, along a rotational direction of the conveyance member, wherein at least part of the inclined surface contacting the conveyance member to bend the conveyance member, a most proximate portion of the inclined surface where a distance to the rotation center is the shortest, a first releasing portion disposed on a downstream side of the most proximate portion in the rotational direction, and configured to release a bending of the conveyance member, an extended portion disposed on a downstream side of the first releasing portion in the rotational direction, the extended portion being extended upwardly with respect to the rotation center in the gravitational direction, a deforming portion disposed on a downstream side of the inner wall surface in the rotational direction, and configured to bend the conveyance member moved and released from the first releasing portion, and a second releasing portion disposed on a downstream side of the deforming portion in the rotational direction and on an upstream side of the opening in the rotational direction, and configured to release the bending of the conveyance member, and wherein a distance between the first releasing portion and the rotation center, and a distance between the extended portion and the rotation center are longer than a distance between the most proximate portion and the rotation center.

Further features of the present disclosure will become apparent from the following description of exemplary embodiments with reference to the attached drawings.

DESCRIPTION OF THE EMBODIMENTS

[Electrophotographic Image Forming Apparatus]

Figure 2:
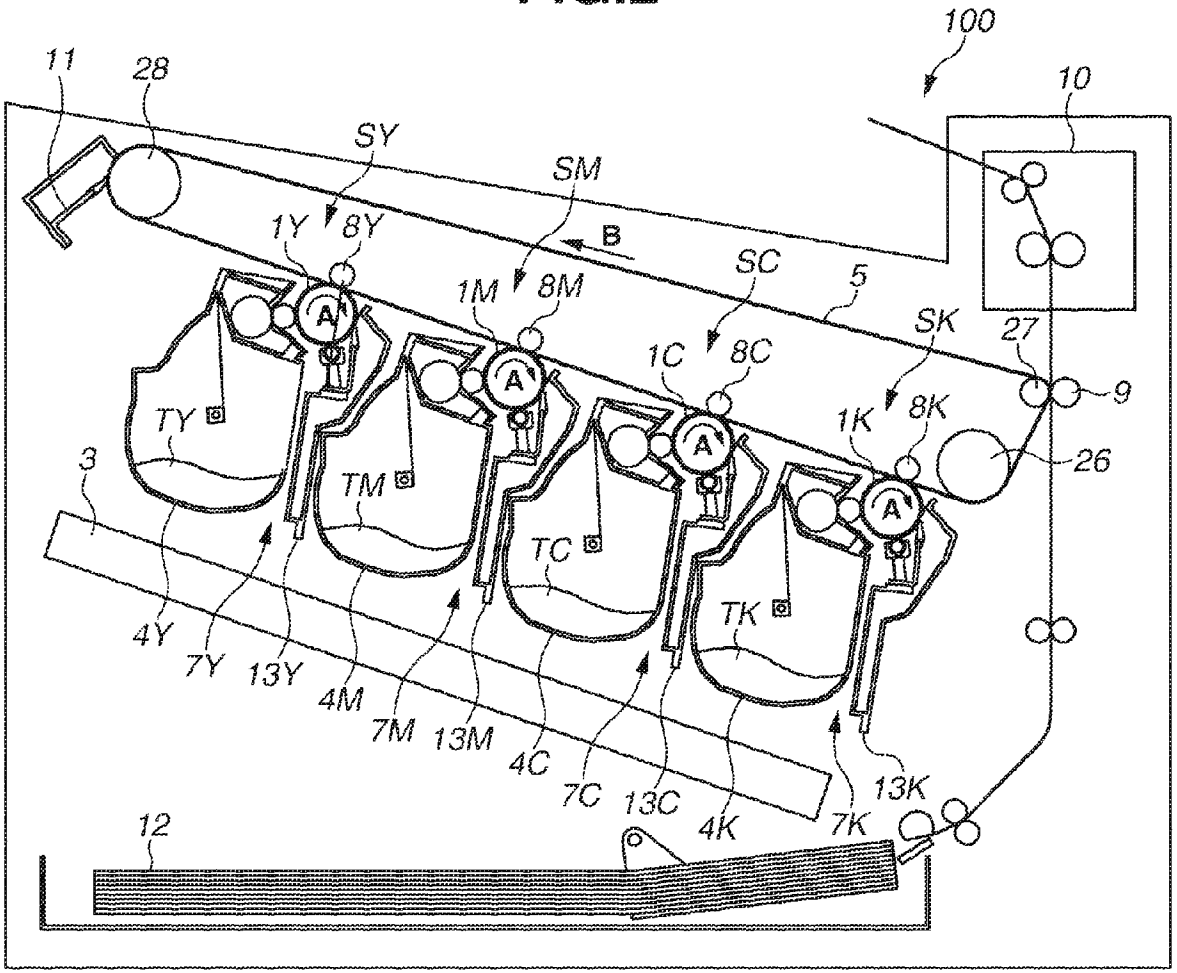
FIG. 2 is a sectional view schematically illustrating an electrophotographic image forming apparatus and process cartridges according to one or more aspects of the present disclosure.
Figure 3:
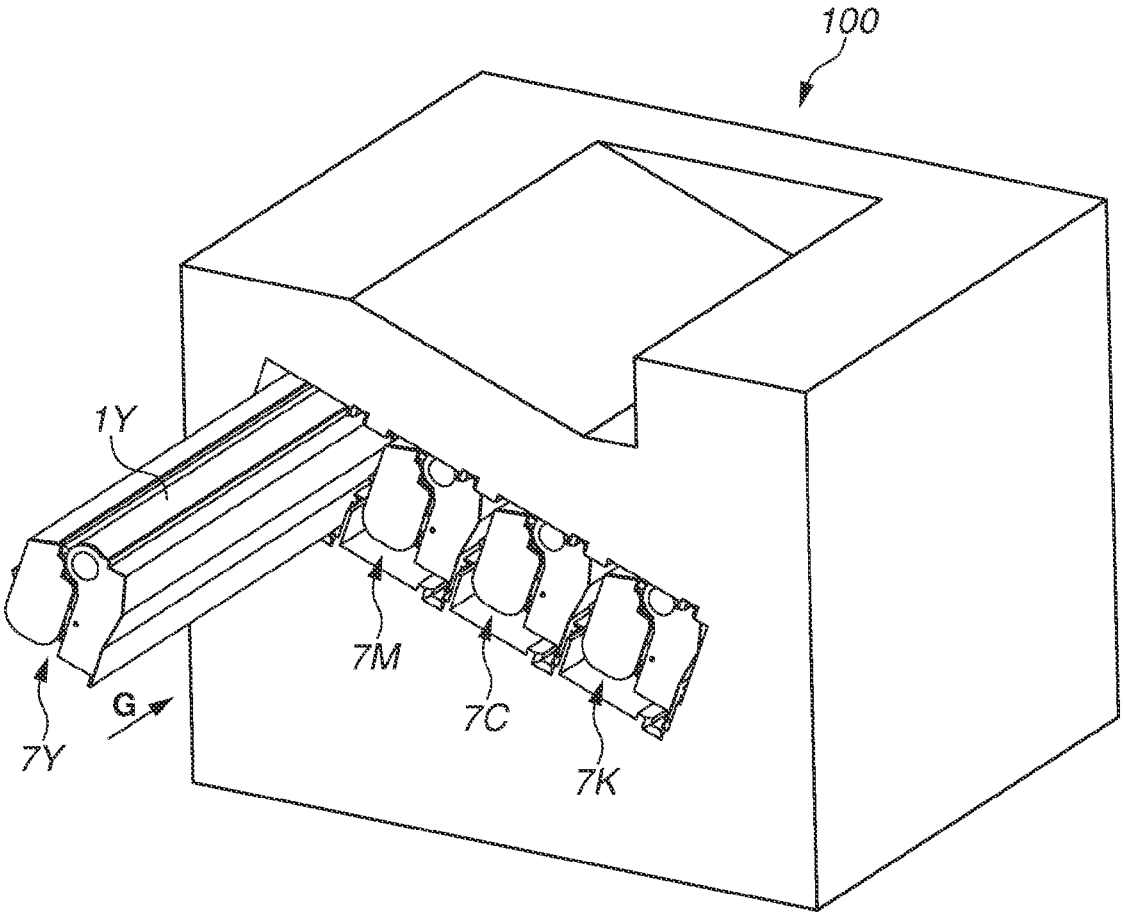
FIG. 3 is a perspective view illustrating the electrophotographic image forming apparatus and process cartridges according to one or more aspects of the present disclosure.

An overall configuration of an electrophotographic image forming apparatus (image forming apparatus) according to an exemplary embodiment of the present disclosure will be described below with reference to FIGS. 2 and 3. FIG. 2 is a sectional view schematically illustrating an image forming apparatus 100 according to the present exemplary embodiment. FIG. 3 is a perspective view illustrating the attachment of process cartridges 7 to the image forming apparatus 100.

As a plurality of image forming units, the image forming apparatus 100 includes a first image forming unit SY, a second image forming unit SM, a third image forming unit SC, and a fourth image forming unit SK for forming a yellow image (Y), a magenta image (M), a cyan image (C) and a black image (K), respectively.

According to the present exemplary embodiment, the first to the fourth image forming units substantially have the same configuration and operation except that images of different colors are formed. Therefore, unless distinction is required, Y, M, C, and K will be omitted in the following descriptions.

According to the present exemplary embodiment, the image forming apparatus 100 includes four photosensitive drums 1 (1Y, 1M, 1C, and 1K) as image bearing members. The photosensitive drum 1 rotates in a direction indicated by an arrow A. A charging roller 2 and a scanner unit (exposure apparatus) 3 are disposed around the photosensitive drum 1.

The charging roller 2 is a charging unit for uniformly charging the surface of the photosensitive drum 1. The scanner unit 3 is an exposure unit for forming an electrostatic image (electrostatic latent image) on the photosensitive drum 1 by irradiating the photosensitive drum 1 with laser based on image information.

Developing apparatuses (hereinafter, referred to as developing units) 4 (4Y, 4M, 4C, and 4K) are disposed around the photosensitive drums 1. Cleaning blades 6 (6Y, 6M, 6C, and 6K) are disposed as cleaning units for removing residual transfer toner (waste toner) remaining on the photosensitive drums 1. Under the cleaning blade 6, a removed developer storage portion (hereinafter referred to as a waste toner containing unit) for storing waste toner is disposed.

According to the present exemplary embodiment, the developing units 4 use nonmagnetic one-component developers, i.e., toners T (TY, TM, TC, and TK). The developing unit 4 performs contact development by bringing the developing roller 17 as a developer bearing member for bearing the toner T into contact with the photosensitive drum 1.

Further, according to the present exemplary embodiment, the photosensitive drum 1, the charging roller 2, the cleaning blade 6, and the waste toner containing unit form a photosensitive member unit 13.

The developing unit 4 and the photosensitive member unit 13 integrally form the process cartridge 7. According to the present exemplary embodiment, all of the process cartridges 7 for respective colors have the same shape. The process cartridges 7 store the toners T (TY, TM, TC, and TK) of respective colors, yellow (TY), magenta (TM), cyan (TC), and black (TK).

Meanwhile, over the four photosensitive drums 1, an intermediate transfer belt 5 as an intermediate transfer member for transferring toner images on the photosensitive drums 1 onto a recording material 12 is disposed so as to face the four photosensitive drums 1.

The intermediate transfer belt 5, in contact with all of the photosensitive drums 1, rotates in a direction indicated by an arrow B. The intermediate transfer belt 5 is stretched over a plurality of supporting members (a drive roller 26, a secondary-transfer opposing roller 27, and a driven roller 28).

Four primary transfer rollers 8 (8Y, 8M, 8C, and 8K) as primary transfer units are juxtaposed on the inner circumference side of the intermediate transfer belt 5 so as to face the respective photosensitive drums 1. On the outer circumference side of the intermediate transfer belt 5, a secondary transfer roller 9 as a secondary transfer unit is disposed at the position facing the secondary-transfer opposing roller 27.

The process cartridges 7 are detachably attached to the image forming apparatus 100 via attachment units such as attachment guides and positioning members (not illustrated) disposed in the image forming apparatus 100.

According to the present exemplary embodiment, the process cartridges 7 are attachable to and detachable from the image forming apparatus 100 along the axis direction of the photosensitive drums 1, as indicated by an arrow G illustrated in FIG. 3.

[Image Forming Process]

At the time of image forming, the surface of the photosensitive drum 1 is uniformly charged by the charging roller 2. Subsequently, the surface of the charged photosensitive drum 1 is exposed to and scanned by laser light corresponding to image information emitted from the scanner unit 3. An electrostatic latent image according to the image information is formed on the photosensitive drum 1. Subsequently, the electrostatic latent image formed on the photosensitive drum 1 is developed as a toner image by the developing unit 4. The toner image formed on the photosensitive drum 1 is transferred onto the intermediate transfer belt 5 by the primary transfer roller 8 (this process is referred to as primary transfer).

For example, in fill color image formation, as the above-described process is sequentially performed by the first image forming unit SY, the second image forming unit SM, the third image forming unit SC, and the fourth image forming unit SK, the toner images of respective colors are sequentially superimposed (primarily transferred) onto the intermediate transfer belt 5. Then, the recording material 12 is conveyed to a secondary transfer portion in synchronization with the movement of the intermediate transfer belt 5. Then, the 4-color toner image on the intermediate transfer belt 5 is secondarily transferred at once onto the recording material 12 by the secondary transfer roller 9 that is in contact with the intermediate transfer belt 5 via the recording material 12.

The recording material 12 with the toner image transferred thereon is conveyed by a fixing apparatus 10 as a fixing unit. When the recording material 12 is heated and pressurized in the fixing apparatus 10, the toner image is fixed onto the recording material 12.

Primary residual transfer toner remaining on the photosensitive drum 1 after the primary transfer process is removed by the cleaning blade 6. Secondary residual transfer toner remaining on the intermediate transfer belt 5 after the secondary transfer process is removed by an intermediate transfer belt cleaning apparatus 11.

The removed secondary residual transfer toner is discharged into a waste toner box (not illustrated) of the image forming apparatus 100.

The image forming apparatus 100 is also capable of forming a monochromatic or multicolor image by using only one image forming unit or some (not all) of the image forming units.

[Process Cartridge]

Figure 1:
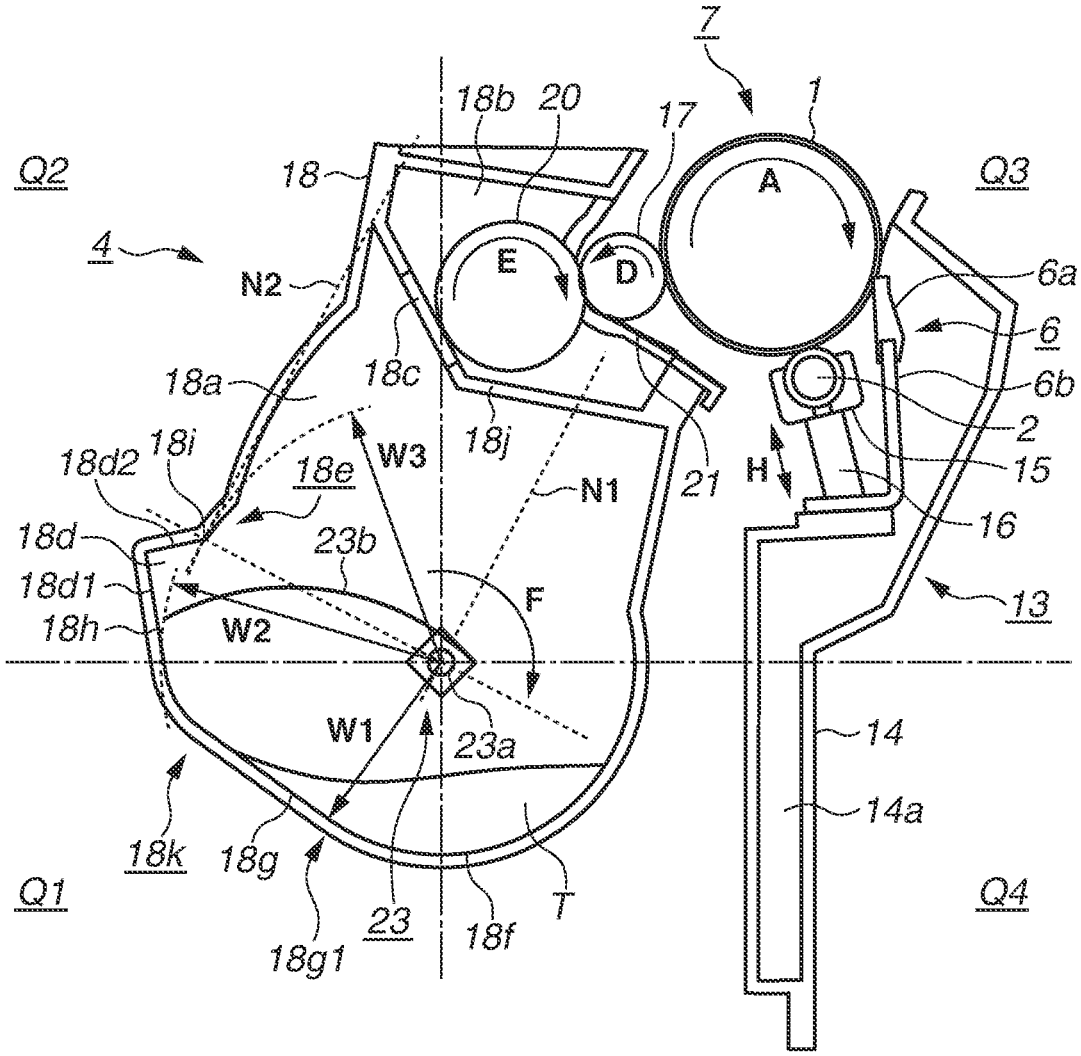
FIG. 1 is a sectional view schematically illustrating a process cartridge according to one or more aspects of the present disclosure.

The overall configuration of the process cartridge 7 attached to the image forming apparatus 100 according to the present exemplary embodiment will be described below with reference to FIG. 1. FIG. 1 is a sectional view illustrating the process cartridge 7 according to the present exemplary embodiment.

The process cartridge 7 includes the developing unit 4 and the photosensitive member unit 13.

The developing unit 4 will be described below. The developing unit 4 includes a developing frame member 18 for supporting various elements in the developing unit 4. The developing unit 4 includes the developing roller 17 that rotates in a direction indicated by an arrow D illustrated in FIG. 1 in contact with the photosensitive drum 1. The developing roller 17 is rotatably supported by the developing frame member 18 via a bearing at both ends in the longitudinal direction (rotational axis direction).

The developing frame member 18 includes a toner supply roller 20 as a developer supply member rotating in a direction indicated by an arrow E in contact with the developing roller 17, and a developing blade 21 as a developer regulating member for regulating the toner layer on the developing roller 17. Meanwhile, image forming apparatus 100 further includes a power source that is respectively connected with the developing roller 17 and the toner supply roller 20. The image forming apparatus 100 further includes a control unit for controlling the amount of toner supply to the developing roller 17 by changing the applied voltages from the power source to the developing roller 17 and the toner supply roller 20. The toner T supplied from the toner supply roller 20 to the developing roller 17 is regulated and triboelectrically charged by the developing blade 21. Thus, the toner T is negatively charged.

The developing frame member 18 further includes a conveyance member 23 having elasticity for conveying the stored toner T by rotating in a direction indicated by an arrow F. The conveyance member 23 has a rotational axis 23*a* extending in the axis direction of the developing roller 17. The conveyance member 23 also has a conveyance sheet 23*b* as a sheet-like conveyance member having elasticity. With one end attached to the rotational axis 23*a*, the conveyance sheet 23*b* stirs and conveys the toner. In the following descriptions, the center of the rotational axis 23*a* is referred to as a rotation center of the conveyance member 23.

The developing frame member 18 includes a partition 18*j*. The partition 18*j* divides the inside of the developing frame member 18 into a developing chamber 18*b* for storing the developing roller 17 and a conveyance chamber 18*a* for storing the conveyance member 23. The partition 18*j* is provided with an opening 18*c* for communicating between the developing chamber 18*b* and the conveyance chamber 18*a*. The conveyance member 23 supplies the toner T to the developing chamber 18*b* through the opening 18*c*.

As illustrated in FIG. 1, according to the present exemplary embodiment, the developing chamber 18*b* is positioned above the conveyance chamber 18*a* in the gravitational direction when the developing unit 4 is oriented for image formation. The opening 18*c* is positioned above the rotation center of the conveyance member 23 in the gravitational direction. More specifically, the developing unit 4 according to the present exemplary embodiment pumps up the toner T from the conveyance chamber 18*a* toward the developing chamber 18*b*, i.e., from bottom up in the gravitational direction (against gravity).

The orientation in which the developing unit 4 performs image formation refers to the orientation in which the developing roller 17 is in contact with the photosensitive drum 1.

The photosensitive member unit 13 will be describe below. The photosensitive member unit 13 includes a cleaning frame member 14 as a frame member for supporting various elements in the photosensitive member unit 13. The photosensitive drum 1 is attached to the cleaning frame member 14 rotatably in a direction indicated by an arrow A illustrated in FIG. 4 via a bearing member.

A charging roller bearing 15 is attached to the cleaning frame member 14 along the straight line passing through the rotation center of the charging roller 2 and the center of the axis line of the photosensitive drum 1. The charging roller bearing 15 is attached movably in directions indicated by arrows H illustrated in FIG. 1. The charging roller 2 is rotatably attached to the charging roller bearing 15. The charging roller bearing 15 is urged toward the photosensitive drum 1 by a charging roller pressurizing spring 16 as an urging unit.

The cleaning blade 6 is formed of an elastic member 6*a* for removing residual transfer toner (waste toner) remaining on the surface of the photosensitive drum 1 after primary transfer, and a supporting member 6*b* for supporting the elastic member 6*a*.

Waste toner removed from the surface of the photosensitive drum 1 by the cleaning blade 6 falls in the space formed by the cleaning blade 6 and the cleaning frame member 14 in the gravitational direction, and is stored in a waste toner containing unit 14*a*.

[Configuration of Toner Conveyance in Example of Prior Art]

The conventional configuration in which the toner in the conveyance chamber 18*a* is conveyed to the developing chamber 18*b* will be described below with reference to FIGS. 4, 5A, 5B, 5C, and 5D. FIGS. 4, 5A, 5B, 5C, and 5D are sectional views illustrating the process cartridge 107 using a conventional developing unit 104.

A conveyance sheet 123*b* is in contact with the inner wall surface of a conveyance chamber 118*a*. A conveyance member 123 rotates in a state where the conveyance sheet 123*b* is bent. The conveyance chamber 118*a* has a releasing position 118*e* where the conveyance sheet 123*b* is released from the bent state. When the conveyance sheet 123*b* passes through the releasing position 118*e*, the force generated when the conveyance sheet 123*b* is released from the bent state throws up the toner on the conveyance sheet 123*b* and conveys the toner to the toner supply roller 20 in a developing chamber 118*b* through an opening 118*c*.

Figure 4:
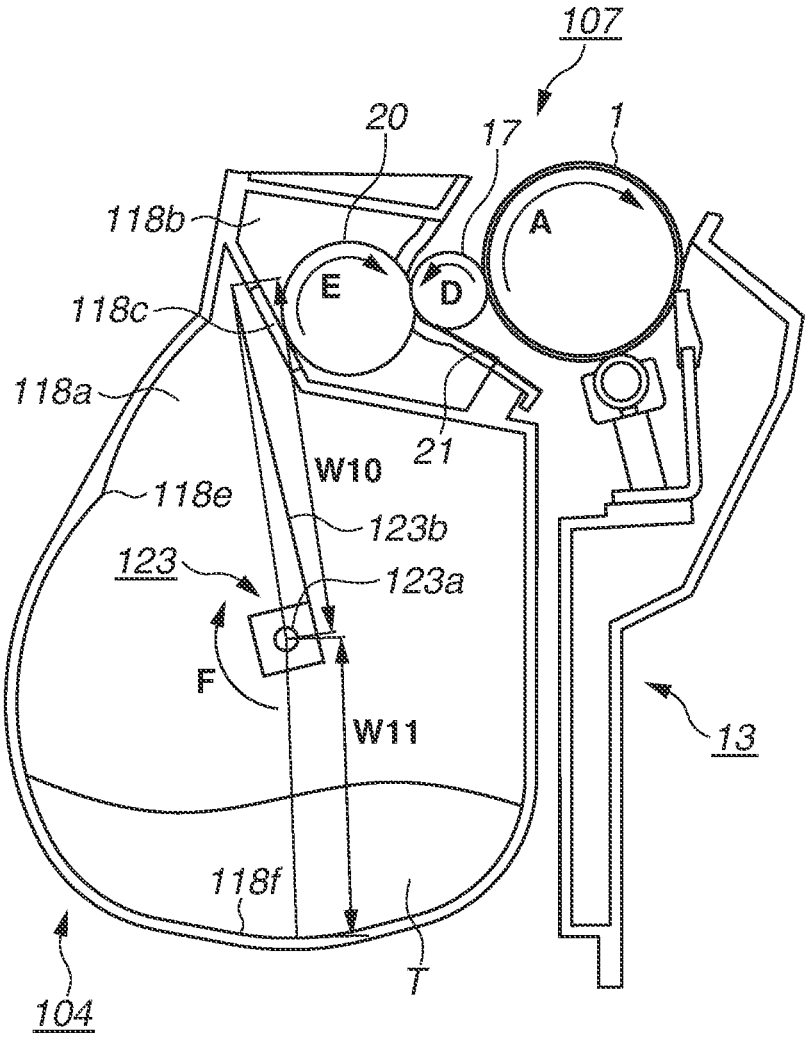
FIG.4 PRIOR ART
FIG. 4 is a sectional view illustrating a process cartridge according to an example of the prior art.

As illustrated in FIG. 4, the length of the conveyance sheet 123*b* is set so that a length W10 from the center of a rotational axis 123*a* to the leading edge of the conveyance sheet 123*b* is longer than a length W11 from the center of the rotational axis 123*a* to a bottom portion 118*f* of the conveyance chamber 118*a*, i.e., a condition W10>W11 is satisfied. Thus, even the toner at the bottom portion 118*f* of the conveyance chamber 118*a* can be stirred and conveyed.

The states of the conveyance sheet 123*b* and the toner during one rotation of the conveyance member 123 will be described below with reference to FIGS. 5A, 5B, 5C, and 5D.

Figure 5A:
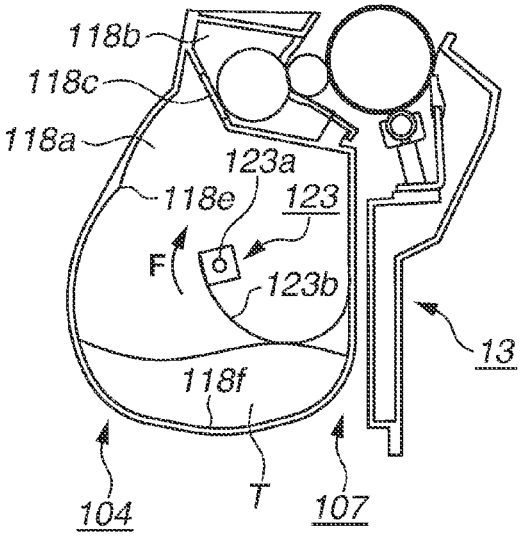
FIG.5A PRIOR ART
FIGS. 5A, 5B, 5C, and 5D illustrate toner conveyance in a configuration of the example of the prior art.
Figure 5B:
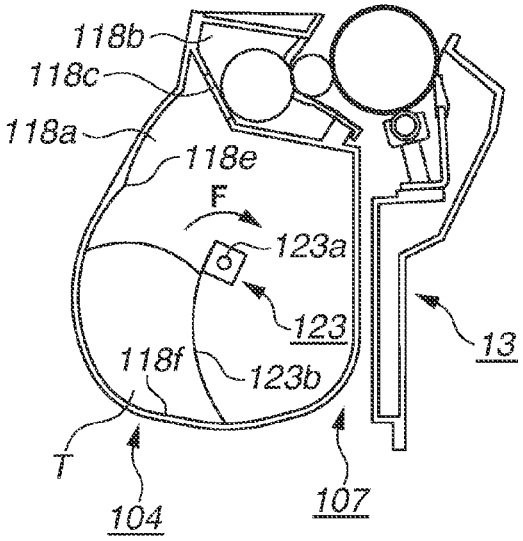
FIG.5B PRIOR ART
Figure 5C:
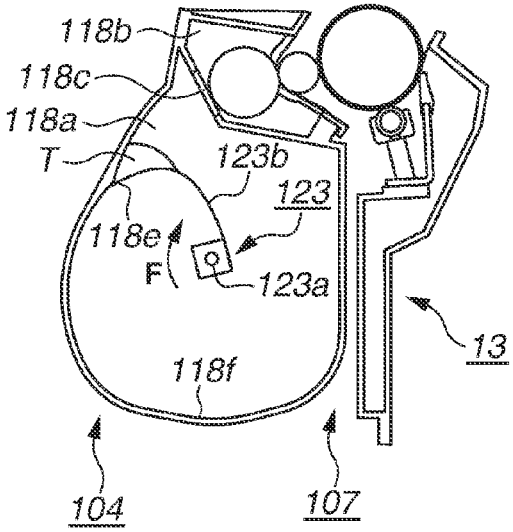
FIG.5C PRIOR ART
Figure 5D:
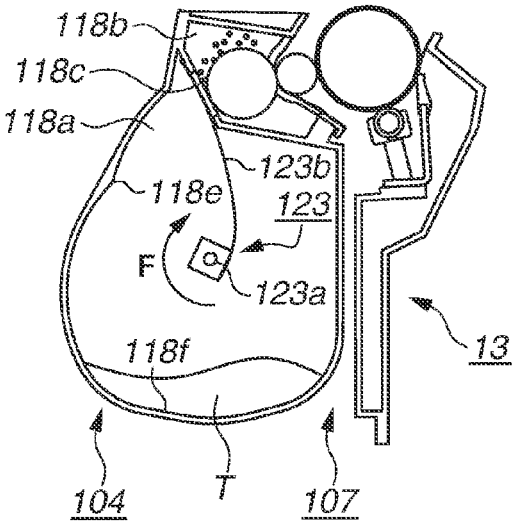
FIG.5D PRIOR ART

FIG. 5A illustrates the state of the toner when the conveyance sheet 123*b* enters a phase of starting pressing the toner surface. The conveyance member 123 rotates in a direction indicated by an arrow F, and the conveyance sheet 123*b* enters the phase of raising and conveying the toner, as illustrated in FIG. 5B. The conveyance member 123 further rotates in the direction indicated by the arrow F, and the conveyance sheet 123*b* reaches the phase of the releasing position 118*e*, as illustrated in FIG. 5C. Then, immediately after the conveyance sheet 123*b* passed through the releasing position 118*e*, the conveyance sheet 123*b* is released from the bent state, and the toner on the conveyance sheet 123*b* is thrown up toward the opening 118*c*, as illustrated in FIG. 5D. When the conveyance sheet 123*b* is released from the bent state, an elastic restoring force causes the conveyance sheet 123*b* to convey the toner to the opening 118*c* and collide with the opening 118*c* to push the toner into the developing chamber 118*b*. Subsequently, the conveyance member 123 rotates in the direction indicated by the arrow F, and then the conveyance sheet 123*b* enters the phase illustrated in FIG. 5A again. The conveyance member 123 keeps rotating in the direction indicated by the arrow F in this way. Each time the conveyance sheet 123*b* passes through the phase of the releasing position 118*e*, the conveyance sheet 123*b* throws up the toner thereon and conveys the toner into the developing chamber 118*b* through the opening 118*c*. In the conventional toner conveyance configuration, when the conveyance sheet 123*b* is released from the bent state only once immediately after passing through the releasing position 118*e*, toner is supplied from the conveyance chamber 118*a* to the developing chamber 118*b*.

[Conveyance Chamber Configuration According to Present Exemplary Embodiment]

The conveyance chamber 118*a* according to the present exemplary embodiment will be described below with reference to FIG. 1.

The inner side of the conveyance chamber 18*a* is provided with an inner wall surface 18*k*. At least part of the inner wall surface 18*k* contacts the conveyance sheet 23*b* of the conveyance member 23 to bend the conveyance sheet 23*b*. The inner wall surface 18*k* is extended from the bottom portion 18*f* below conveyance member 23 in the gravitational direction to above the rotation center of the conveyance member 23 in the gravitational direction along the rotational direction indicated by the arrow F of the conveyance member 23.

The inner wall surface 18*k* is provided with a conveyance regulating surface 18*g* as an inclined surface. The conveyance regulating surface 18*g* is positioned below the rotation center of the conveyance member 23 in the gravitational direction. Further, the conveyance regulating surface 18*g* is inclined toward an upside in the gravitational direction and toward a direction departing from the rotation center of the conveyance member 23 in the horizontal direction, along the rotational direction indicated by the arrow F from the bottom portion 18*f*. At least part of the conveyance regulating surface 18*g* contacts the conveyance sheet 23*b* to bend the conveyance member 23. The conveyance member 23 in a bent state conveys the toner upward.

The portion on the conveyance regulating surface 18*g* where the distance to the rotation center of the conveyance member 23 is the shortest is defined as a most proximate portion. The distance between the most proximate portion and the rotation center of the conveyance member 23 is referred to as a distance W1. The conveyance regulating surface 18*g* according to the present exemplary embodiment is extended from the most proximate portion toward the downstream side in the rotational direction indicated by the arrow F so that the distance to the rotation center of the conveyance member 23 becomes longer than the distance W1. More specifically, the distance between the conveyance regulating surface 18*g* and the rotation center of the conveyance member 23 gradually increases from the most proximate portion toward the downstream side in the rotational direction indicated by the arrow F. Accordingly, the bending of the conveyance member 23 in contact with the conveyance regulating surface 18*g* gradually decreases toward the downstream side in the rotational direction indicated by the arrow F.

The inner wall surface 18*k* is provided with a first releasing portion 18*h* on the downstream side of the most proximate portion in the rotational direction indicated by the arrow F. A distance W2 between the first releasing portion 18*h* and the rotation center of the conveyance member 23 is longer than the distance W1.

The first releasing portion 18*h* will be described in detail below. As described above, the conveyance regulating surface 18*g* contacts the conveyance sheet 23*b* to bend the conveyance sheet 23*b*. At this timing, the conveyance regulating surface 18*g* is in a state of holding the conveyance sheet 23*b* against the elastic restoring force of the conveyance sheet 23*b*. However, the bending of the conveyance sheet 23*b* decreases. When the elastic restoring force of the conveyance sheet 23*b* becomes larger than the force of the conveyance regulating surface 18*g* for holding the conveyance sheet 23*b*, the conveyance sheet 23*b* is restored by its own elasticity. At this timing, the bending of the conveyance sheet 23*b* is released and the conveyance sheet 23*b* is thrown up. When the bending is released (thrown up), the rotation speed of the leading edge of the conveyance sheet 23*b* becomes larger than the rotation speed of the rotation center of the conveyance member 23. The portion where the bending is released (thrown up) is the first releasing portion 18*h*. According to the present exemplary embodiment, the first releasing portion 18*h* is formed by gradually separating the conveyance regulating surface 18*g* from the center of the conveyance member 23.

The inner wall surface 18*k* is provided with an extended portion 18*d*1 on the downstream side of the first releasing portion 18*h* in the rotational direction indicated by the arrow F. As illustrated in FIG. 1, the first releasing portion 18*h* and the extended portion 18*d*1 are continuously disposed. The extended portion 18*d*1 is extended from the first releasing portion 18*h* upwardly above the rotation center of the conveyance member 23 in the gravitational direction while maintaining the distance to the rotation center of the conveyance member 23 longer than the distance W1.

More specifically, as described above, the inner wall surface 18*k* includes the conveyance regulating surface 18*g*, the first releasing portion 18*h*, and the extended portion 18*d*1. As illustrated in FIG. 1, the portion on the inner wall surface 18*k* where the distance to the rotation center of the conveyance member 23 is the shortest is the above-described most proximate portion (18*g*1) of the conveyance regulating surface 18*g*. In other words, the inner wall surface 18*k* is extended upwardly from the most proximate portion above the rotation center of the conveyance member 23 (in the gravitational direction) along the rotational direction indicated by the arrow F while maintaining the distance to the rotation center of the conveyance member 23 longer than the distance W1 at the most proximate portion.

In this way, in the present exemplary embodiment, the conveyance regulating surface 18*g* that forms the inclined surface is positioned below the rotation center (23*a*) of the conveyance member 23 and is also extended, from the position of the most proximate portion 18*g*1, toward the downstream side in the rotational direction of the conveyance member 23 indicated by the arrow F in such a manner that the distance to the conveyance member 23 (rotation center 23*a*) increases. In other words, the inclined surface (the conveyance regulating surface 18*g*) extends from the position of the most proximate portion 18*g*1 in such a way as to more depart from the rotation center (23*a*) of the conveyance member 23 as the inclined surface extends toward the downstream side in the rotational direction of the conveyance member 23 indicated by the arrow F.

Suppose that the area around the rotation center of the conveyance member 23 is divided by a horizontal plane passing through the rotation center of the conveyance member 23 and a vertical plane passing through the rotation center of the conveyance member 23 and perpendicularly intersecting with the horizontal plane. At this timing, the area below the horizontal plane passing through the rotation center of the conveyance member 23 in the gravitational direction and on the downstream side of the vertical plane in the rotational direction indicated by the arrow F is referred to as an area Q1. The areas arranged along the rotational direction indicated by the arrow F from the area Q1 are referred to as areas Q2, Q3, and Q4, respectively. In this case, the conveyance regulating surface 18*g* is disposed in the area Q1. The most proximate portion is also disposed in the area Q1. More specifically, according to the present exemplary embodiment, the conveyance regulating surface 18*g* includes in the area Q1 a portion (most proximate portion) where the bending of the conveyance member 23 is maximized and a portion where the bending of the conveyance member 23 is gradually released.

On the downstream side of the inner wall surface 18*k* in the rotational direction indicated by the arrow F, there is disposed a deforming portion 18*i* for contacting and catching the conveyance member 23 moved and released from the first releasing portion 18*h* to bend the conveyance member 23 again. The deforming portion 18*i* also holds the conveyance sheet 23*b* in a bent state against the elasticity of the conveyance sheet 23*b*. According to the present exemplary embodiment, the conveyance member 23 is configured to be away from the deforming portion 18*i* when the conveyance sheet 23*b* is released from the first releasing portion 18*h* (when the leading edge of the conveyance sheet 23*b* reaches the first releasing portion 18*h*). As illustrated in FIG. 1, the deforming portion 18*i* is disposed above the rotation center of the conveyance member 23 in the gravitational direction.

On the downstream side of the deforming portion 18*i* in the rotational direction indicated by the arrow F and on the upstream side of the opening 18*c* in the rotational direction indicated by the arrow F, there is disposed a second releasing portion 18*e* for releasing the bending of the conveyance member 23 by the deforming portion 18*i*. According to the present exemplary embodiment, the second releasing portion 18*e* is formed above the rotation center of the conveyance member 23 in the gravitational direction and is positioned in the area Q2.

Similar to the first releasing portion 18*h*, the bending of the conveyance member 23 is released at the second releasing portion 18*e* by the elasticity of the conveyance sheet 23*b*, for example, when the bending of the conveyance sheet 23*b* decreases or the leading edge of the conveyance sheet 23*b* is released from the deforming portion 18*i*. More specifically, when the elastic restoring force of the conveyance sheet 23*b* becomes larger than the force for holding the conveyance sheet 23*b*, the conveyance sheet 23*b* is restored by its own elasticity. At this timing, the bending of the conveyance sheet 23*b* is released and the conveyance sheet 23*b* is thrown up. When the bending is released (thrown up), the rotation speed of the leading edge of the conveyance sheet 23*b* becomes higher than the rotation speed of the rotation center of the conveyance member 23.

On the other hand, according to the present exemplary embodiment, a connecting portion 18*d*2 connects between the deforming portion 18*i* and the extended portion 18*d*1 of the inner wall surface 18*k*. The connecting portion 18*d*2 is a surface inclined toward the upside in the gravitational direction from the extended portion 18*d*1 and toward a direction approaching the rotation center of the conveyance member 23 in the horizontal direction, toward the downstream side in the rotational direction of the conveyance member 23 indicated by the arrow F. In the conveyance chamber 18*a*, a recessed portion 18*d* is formed by the extended portion 18*d*1 and the connecting portion 18*d*2. In this case, the recessed portion 18*d* of the conveyance chamber 18*a* is formed in the above-described area Q2. As illustrated in FIG. 1, the distance from the connecting portion between the extended portion 18*d*1 and the connecting portion 18*d*2 to the rotation center of the conveyance member 23 is longer than the above-described distance W2.

Figure 7:
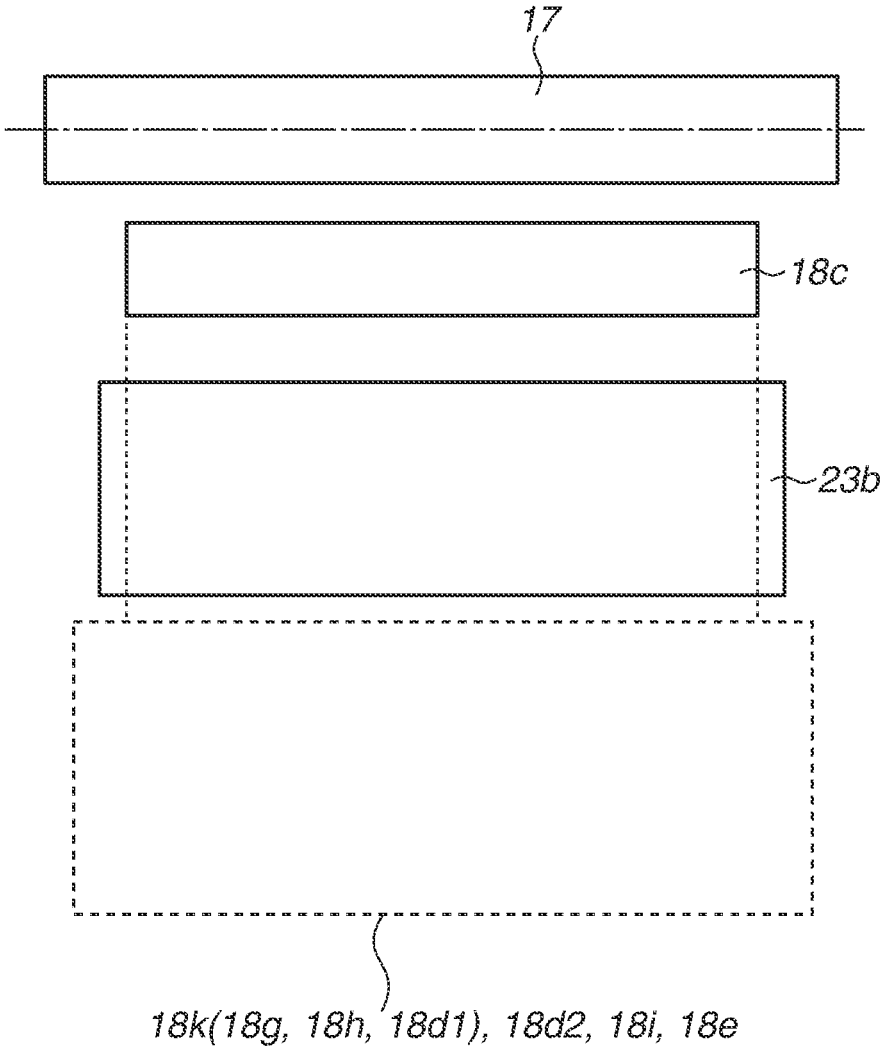
FIG. 7 illustrates a longitudinal configuration of a developing apparatus according to one or more aspects of the present disclosure.

Further, according to the present exemplary embodiment, the inner wall surface 18*k*, the deforming portion 18*i*, and the second releasing portion 18*e* are formed longer than the opening 18*c* in the axis direction of the developing roller 17 (FIG. 7). This is intended to supply toner to the developing chamber 18*b* over the entire longitudinal range through the opening 18*c*.

As described above, the distance W1 denotes the distance between the rotation center of the conveyance member 23 and the most proximate portion, the distance W2 denotes the distance between the rotation center of the conveyance member 23 and the first releasing portion 18*h*, and a distance W3 denotes the distance between the rotation center of the conveyance member 23 and the deforming portion 18*i*. According to the present exemplary embodiment, the distances W1, W2, and W3 are set so that conditions W1<W2 and W3<W2 are satisfied.

According to the present exemplary embodiment, the extended portion 18*d*1 is inclined at an angle larger than the angle with respect to the horizontal plane where toner naturally falls (hereinafter this angle is referred to as an angle of repose). Thus, toner that was unable to pass through the recessed portion 18*d* by the rotation of the conveyance member 23 does not remain at the recessed portion 18*d* but falls onto the lower portion of the conveyance chamber 18*a*.

Suppose that a perpendicular line N2 (equivalent to a second perpendicular line) passing through the deforming portion 18*i* and a perpendicular line N1 (equivalent to the first perpendicular line) passing through the rotation center of the conveyance member 23 are drawn perpendicularly to the straight line connecting the deforming portion 18*i* and the rotation center of the conveyance member 23. In other words, the line N2 perpendicularly intersects with the straight line connecting the rotation center of the conveyance member 23 and the deforming portion 18*i* and passes through the deforming portion 18*i*, and the line N1 perpendicularly intersects with the straight line connecting the rotation center of the conveyance member 23 and the deforming portion 18*i* and passes through the rotation center. In this case, the opening 18*c* is disposed so that at least part of the opening 18*c* is overlapped with the area between the perpendicular lines N1 and N2.

[Toner Conveyance According to Present Exemplary Embodiment]

Toner conveyance according to the present exemplary embodiment will be described below with reference to FIGS. 6A, 6B, 6C, 6D, and 6E.

Figure 6A:
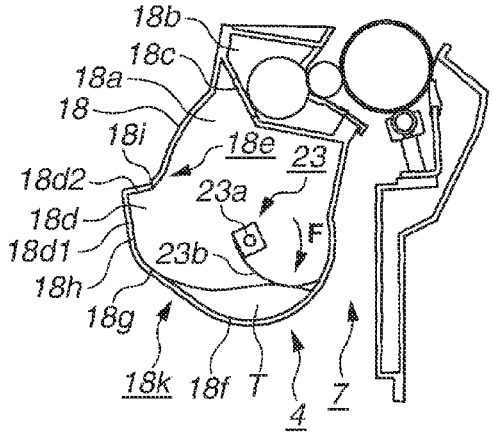
FIGS. 6A, 6B, 6C, 6D, and 6E illustrate toner conveyance in a configuration according to one or more aspects of the present disclosure.
Figure 6B:
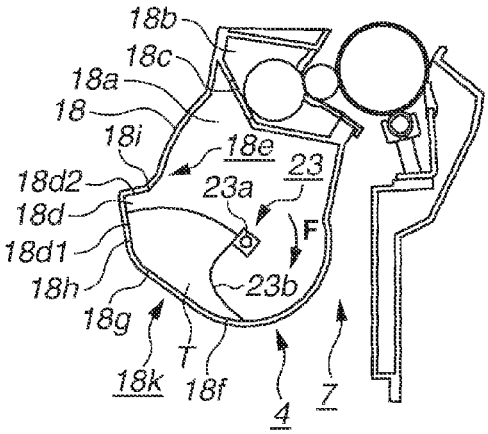
Figure 6C:
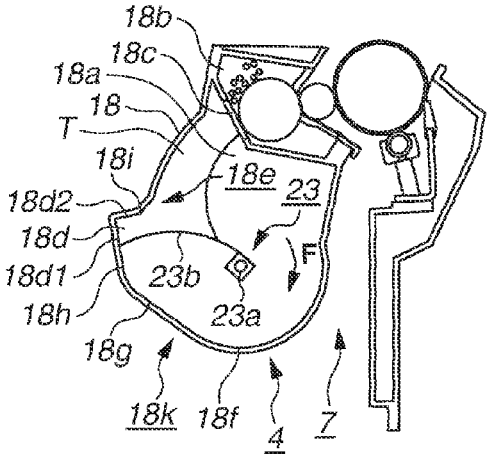

As illustrated in FIG. 6A, the conveyance sheet 23*b* starts pressing the toner surface by the rotation of the conveyance member 23. Subsequently, as illustrated in FIG. 6B, the conveyance sheet 23*b* passes through the vicinity of the bottom portion 18*f* of the conveyance chamber 18*a*, and then the conveyance sheet 23*b* raises and conveys the toner along the conveyance regulating surface 18*g*. In the configuration of the present exemplary embodiment, from the bottom portion 18*f*, the conveyance regulating surface 18*g* is formed so as to gradually separate from the rotation center of the conveyance member 23. Thus, after the conveyance sheet 23*b* reaches the bottom portion 18*f*, the moving speed of the leading edge of conveyance sheet 23*b* gradually increases, as illustrated in FIG. 6C. Then, before the conveyance sheet 23*b* reaches the recessed portion 18*d*, the bending of the conveyance sheet 23*b* is released and thrown up at the first releasing portion 18*h*.

When the leading edge of the conveyance sheet 23*b* is positioned at the first releasing portion 18*h*, the conveyance sheet 23*b* is not in contact with the deforming portion 18*i*. Therefore, when the bending of the conveyance sheet 23*b* is released, the toner T between the conveyance sheet 23*b* and the inner wall surface 18*k* of the conveyance chamber 18*a* is pushed out by the variation in toner pressure. This is the first toner supply.

As described above, when the perpendicular line N2 passing through the deforming portion 18*i* and the perpendicular line N1 passing through the rotation center of the conveyance member 23 are drawn perpendicularly to the straight line connecting the deforming portion 18*i* and the rotation center of the conveyance member 23, the opening 18*c* is disposed so that at least part of the opening 18*c* is overlapped with the area between the perpendicular lines N1 and N2. For this reason, the pushed-out toner is likely to move toward the opening 18*c*.

Figure 6D:
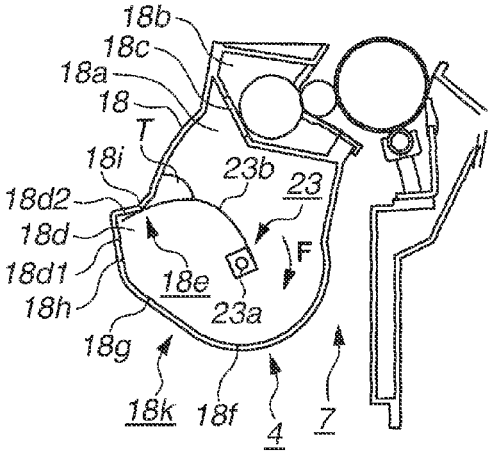
Figure 6E:
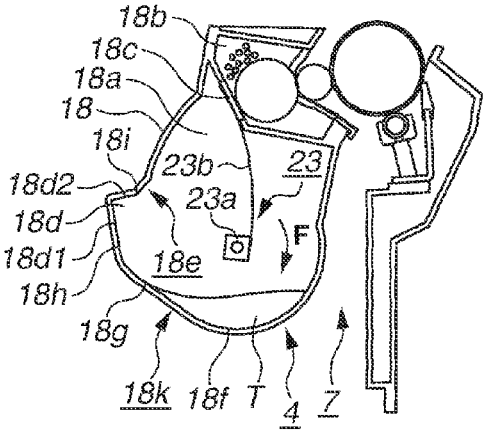

When the bending of the conveyance sheet 23*b* is released, the conveyance sheet 23*b* is caught by the deforming portion 18*i* as illustrated in FIG. 6D. The conveyance sheet 23*b* bends again when the conveyance sheet 23*b* comes in contact with the deforming portion 18*i*. After the conveyance sheet 23*b* passes through the deforming portion 18*i*, the bent state of the conveyance sheet 23*b* is released at the second releasing portion 18*e*, and the toner is thrown up toward the opening 18*c* again (FIG. 6E). This is the second toner supply.

In the above-described configuration of the present exemplary embodiment, the bending of the conveyance sheet 23*b* is released and thrown up a plurality of times during one rotation of the conveyance member 23. This configuration enables increasing the number of times of toner supply from the conveyance chamber 18*a* to the developing chamber 18*b* without increasing the number of rotations (rotation speed) of the conveyance member 23 and the number of the conveyance sheets 23*b*.

In the configuration of the present exemplary embodiment, from the most proximate portion, the bending of the conveyance member 23 gradually decreases as the conveyance regulating surface 18*g* gradually separates from the center of the conveyance member 23, along the rotational direction indicated by the arrow F of the conveyance member 23. Thus, the conveyance member 23 is thrown up at the first releasing portion 18*h*. For example, if there is disposed a convex (refer to FIG. 4) projecting to the inside of the developing frame member 18 as illustrated in an example of the prior art, such as the releasing position 118*e*, the capacity of the conveyance chamber 18*a* for storing toner will decrease. Depending on the position of the convex, toner will remain on the upper side of the convex, possibly making it difficult to efficiently use the toner. On the other hand, the configuration of the present exemplary embodiment does not decrease the capacity of the conveyance chamber 18*a* for storing toner, making it possible to efficiently use the toner.

[Verification of Effects of Present Exemplary Embodiment]

To confirm effects of the present exemplary embodiment, we confirmed the relation between the difference between voltages applied to the developing roller 17 and the toner supply roller 20 and the adaptability of the solid image density. In this case, suppose a voltage difference $\Delta V = Vrs - Vdr$ in a case where a voltage Vdr is applied to the developing roller 17 and a voltage Vrs is applied to the toner supply roller 20. In the present exemplary embodiment, since negatively charged toner is used, applying the voltages Vdr and Vrs so that the voltage difference $\Delta V$ becomes negative enables supplying a larger amount of toner from the toner supply roller 20 to the developing roller 17. This means that favorable adaptability of the solid image density is provided if the solid image density can be secured even with the positive voltage difference $\Delta V$.

As a comparison of the toner supply performance, we carried out the solid image density adaptability evaluation by measuring the decreased amount of density when high-quality printing is continuously performed. As an evaluation condition, after leaving the image forming apparatus 100 for 1 day in an evaluation environment (50% Rh, 25.0° C.) to make the apparatus fit into the evaluation environment, three sheets of a solid image were output. In the evaluation, the density difference between the leading and trailing edges of the third sheet of the solid image was measured by using spectordensitometer 500 from X-Rite. Evaluation images were output with a single color.

Table 1 indicates relation between the above-described density difference and the voltage difference ΔV in configurations according to the example of the prior art and the present exemplary embodiment. Referring to Table 1, "o" denotes that the density difference between the leading and trailing edges of paper is smaller than 0.2, and "x" denotes that the density difference between the leading and trailing edges of paper is 0.2 or greater.

TABLE 1

| | Voltage difference ΔV | | | | |
|---|---|---|---|---|---|
| | −50 V | −25 V | 0 V | 25 V | 50 V |
| Example of prior art | o | x | x | x | x |
| Exemplary embodiment | o | o | o | o | x |

With the developing apparatus according to the conventional configuration, the adaptability of the solid image density was able to be secured for up to the voltage difference ΔV=−50 V. In the configuration of the present exemplary embodiment, the adaptability of the solid image density was able to be secured for up to the potential difference ΔV=+25 V. This is because the amount of toner supplied from the toner supply roller 20 to the developing roller 17 was increased with increasing number of times of toner supply from the conveyance chamber 18*a* to the developing chamber 18*b*, enabling stable toner coat formation on the developing roller 17.

As described above, the configuration of the present exemplary embodiment enables increasing the number of times of toner supply from the conveyance chamber 18*a* to the developing chamber 18*b* without increasing the number of rotations (rotation speed) of the conveyance member 23 and the number of the conveyance sheets 23*b*. Therefore, the amount of toner supply from the conveyance chamber 18*a* to the developing chamber 18*b* can be increased.

As described above, according to the present disclosure, it is possible to provide a developing apparatus configured to convey a developer against gravity and capable of increasing the frequency of developer supply from a conveyance chamber to a developing chamber without increasing the rotation speed of a conveyance member.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Applications No. 2016-069288, filed Mar. 30, 2016, and No. 2017-033910, filed Feb. 24, 2017, which are hereby incorporated by reference herein in their entirety.

What is claimed is:

1. A developing apparatus comprising:

a developing frame member including a conveyance chamber, and a developing chamber disposed above the conveyance chamber in a gravitational direction at a time of image formation;

a partition configured to divide an inside of the developing frame member into the developing chamber and the conveyance chamber, and provided with an opening for communicating between the developing chamber and the conveyance chamber;

a developer bearing member stored in the developing chamber;

a conveyance member stored in the conveyance chamber, and configured to rotate to convey developer into the developing chamber through the opening; and an inner wall surface disposed inside the conveyance chamber, wherein the inner wall surface includes:

an inclined surface positioned below a rotation center of the conveyance member in the gravitational direction, and inclined toward an upside in the gravitational direction and toward a direction departing from the rotation center in a horizontal direction, along a rotational direction of the conveyance member, wherein at least part of the inclined surface contacting the conveyance member to bend the conveyance member;

a most proximate portion of the inclined surface where a distance to the rotation center is the shortest;

a first releasing portion disposed on a downstream side of the most proximate portion in the rotational direction, and configured to release a bending of the conveyance member;

an extended portion disposed on a downstream side of the first releasing portion in the rotational direction, the extended portion being extended upwardly with respect to the rotation center in the gravitational direction;

a deforming portion disposed on a downstream side of the inner wall surface in the rotational direction, and configured to bend the conveyance member moved and released from the first releasing portion; and a second releasing portion disposed on a downstream side of the deforming portion in the rotational direction and on an upstream side of the opening in the rotational direction, and configured to release the bending of the conveyance member, and wherein a distance between the first releasing portion and the rotation center, and a distance between the extended portion and the rotation center are longer than a distance between the most proximate portion and the rotation center.

2. The developing apparatus according to claim 1, wherein the second releasing portion is disposed above the rotation center in the gravitational direction.

3. The developing apparatus according to claim 2, wherein the deforming portion is disposed above the rotation center in the gravitational direction.

4. The developing apparatus according to claim 1, wherein an inclination angle of the extended portion with respect to a horizontal plane is larger than an angle of repose of the developer.

5. The developing apparatus according to claim 1, wherein, when an area around the rotation center is divided by a horizontal plane that passes through the rotation center and a vertical plane that passes through the rotation center and perpendicularly intersects with the horizontal plane, the inclined surface is disposed in an area positioned below the horizontal plane in the gravitational direction and on a downstream side in the rotational direction.

6. The developing apparatus according to claim 1, further comprising a connecting portion configured to connect the extended portion and the deforming portion, wherein the connecting portion is a surface inclined toward the upside in the gravitational direction from the extended portion and toward a direction approaching the rotation center in a horizontal direction.

7. The developing apparatus according to claim 1, wherein, in an axis direction of the developer bearing member, lengths of the inner wall surface, the deforming portion, and the second releasing portion are longer than a length of the opening.

8. The developing apparatus according to claim 1, wherein, when a line that perpendicularly intersects with a straight line connecting the rotation center and the deforming portion and passes through the rotation center is a first perpendicular line, and a line that perpendicularly intersects with the straight line connecting the rotation center and the deforming portion and passes through the deforming portion is a second perpendicular line, at least part of the opening overlaps with an area between the first perpendicular line and the second perpendicular line.

9. The developing apparatus according to claim 1, wherein, when a leading edge of the conveyance member reaches the first releasing portion, the conveyance member is separated from the deforming portion.

10. A process cartridge comprising:

an image bearing member; and a developing apparatus, wherein the developing apparatus includes:

a developing frame member including a conveyance chamber, and a developing chamber disposed above the conveyance chamber in a gravitational direction at a time of image formation;

a partition configured to divide an inside of the developing frame member into the developing chamber and the conveyance chamber, and provided with an opening for communicating between the developing chamber and the conveyance chamber;

a developer bearing member stored in the developing chamber;

a conveyance member stored in the conveyance chamber, and configured to rotate to convey developer into the developing chamber through the opening; and an inner wall surface disposed inside the conveyance chamber, wherein the inner wall surface includes:

an inclined surface positioned below a rotation center of the conveyance member in the gravitational direction, and inclined toward an upside in the gravitational direction and toward a direction departing from the rotation center in a horizontal direction, along a rotational direction of the conveyance member, wherein at least part of the inclined surface contacting the conveyance member to bend the conveyance member;

a most proximate portion of the inclined surface where a distance to the rotation center is the shortest;

a first releasing portion disposed on a downstream side of the most proximate portion in the rotational direction, and configured to release a bending of the conveyance member;

an extended portion disposed on a downstream side of the first releasing portion in the rotational direction, the extended portion being extended upwardly with respect to the rotation center in the gravitational direction;

a deforming portion disposed on a downstream side of the inner wall surface in the rotational direction, and configured to bend the conveyance member moved and released from the first releasing portion; and a second releasing portion disposed on a downstream side of the deforming portion in the rotational direction and on an upstream side of the opening in the rotational direction, and configured to release the bending of the conveyance member, and wherein a distance between the first releasing portion and the rotation center, and a distance between the extended portion and the rotation center are longer than a distance between the most proximate portion and the rotation center.

* * * * *